US010890338B2

(12) United States Patent
Theile et al.

(10) Patent No.: US 10,890,338 B2
(45) Date of Patent: Jan. 12, 2021

(54) WATER SYSTEM WITH A CONTINUOUS FLOW HEATER AND A FLUSHING STATION

(71) Applicant: Gebr. Kemper GmbH + Co. KG Metallwerke, Olpe (DE)

(72) Inventors: Tobias Theile, Drolshagen (DE); Robin Diekmann, Borken (DE)

(73) Assignee: GEBR. KEMPER GMBH + CO. KG METALLWERKE, Olme (DE)

( * ) Notice: Subject to any disclaimer, the term of this patent is extended or adjusted under 35 U.S.C. 154(b) by 291 days.

(21) Appl. No.: 15/805,198

(22) Filed: Nov. 7, 2017

(65) Prior Publication Data

US 2018/0135870 A1 May 17, 2018

(30) Foreign Application Priority Data

Nov. 11, 2016 (DE) ..... 20 2016 106 313 U

(51) Int. Cl.
*F24D 17/00* (2006.01)
*E03B 7/04* (2006.01)
(Continued)

(52) U.S. Cl.
CPC ..... *F24D 17/0073* (2013.01); *E03B 7/045* (2013.01); *E03B 7/09* (2013.01); *F24D 19/0092* (2013.01); *F24H 1/08* (2013.01)

(58) Field of Classification Search
CPC . E03B 7/045; E03B 7/006; E03B 7/08; E03B 7/09; F24D 19/0092; F24D 17/0073; F24H 1/08
See application file for complete search history.

(56) References Cited

U.S. PATENT DOCUMENTS 4,246,764 A * 1/1981 Papadakos ..... F25B 29/003 122/18.2
2017/0241113 A1* 8/2017 Bartenstein ..... B08B 9/0325

FOREIGN PATENT DOCUMENTS

CH 706516 A1 11/2013
CH 706516 B1 * 1/2016 ..... F24D 17/0073
(Continued)

OTHER PUBLICATIONS

German Search Report of German Application No. 202016106313.2, dated Nov. 16, 2017.
(Continued)

*Primary Examiner* — Steven S Anderson, II
(74) *Attorney, Agent, or Firm* — Fay Sharpe LLP

(57) ABSTRACT

The present invention relates to a water system with a warm water line (3) for supplying at least one first consumer (4, 4*a*, 4*b*) connected thereto with warm water and a continuous flow heater (1), in which cold water introduced into the latter is heatable, connected to said warm water line (3). In case warm water remains in the continuous flow heater, because it is only partially consumed, limescale deposit can reduce the performance and the service life of the continuous flow heater. Limescale deposit is particularly likely to happen in stagnant warm water. The present invention aims to solve aforesaid problem in that a flushing station (2) connected to said warm water line (3) is provided, by way of which stagnant water in said warm water line can be drained in a chronological sequence until the water contained in said continuous flow heater (1) is below a predetermined setpoint temperature.

17 Claims, 4 Drawing Sheets

(51) Int. Cl.

| | |
|---|---|
| ***E03B 7/09*** | (2006.01) |
| ***F24H 1/08*** | (2006.01) |
| ***F24D 19/00*** | (2006.01) |

(56) References Cited

FOREIGN PATENT DOCUMENTS

| | | | | | |
|---|---|---|---|---|---|
| DE | 19504730 | C1 | | 4/1996 | |
| DE | 102006032048 | A1 | | 1/2008 | |
| DE | 202008003349 | U1 | | 9/2008 | |
| DE | 102010018086 | A1 | * | 10/2011 | ..... F28D 9/005 |
| DE | 102010018086 | A1 | | 10/2011 | |
| DE | 202015003756 | | | 3/2015 | |
| DE | 202015103940 | | | 11/2016 | |
| EP | 1845207 | A1 | | 10/2007 | |
| EP | 2166159 | A2 | | 3/2010 | |
| EP | 3098553 | | | 5/2016 | |
| WO | WO-2005124494 | A2 | * | 12/2005 | ..... E03B 7/006 |
| WO | WO 2009/047586 | A1 | | 4/2009 | |

OTHER PUBLICATIONS

EP Search report for EP application No. 17200950.8 dated Mar. 12, 2018.

* cited by examiner

WATER SYSTEM WITH A CONTINUOUS FLOW HEATER AND A FLUSHING STATION

The present invention relates to a water system having the features of the preamble of claim 1. A generic system is generally known.

Such water systems have long been known in prior art, in which water flowing in a warm water line is heated by way of a continuous flow heater. Such water systems can be installed in single-family houses or also large buildings with several apartments, in office buildings, industrial buildings, hospitals and the like.

When warm water is tapped via a consumer, then it has previously been heated in the continuous flow heater. Cold water flows through a water supply line into the continuous flow heater, is heated during its flow through the continuous flow heater and flows as warm water out from the continuous flow heater into the warm water line. Once warm water is no longer be tapped from the warm water line, the water just heated in the continuous flow heater stagnates in the latter. Even if the continuous flow heater is switched off immediately after tapping, so that no more water is heated, it cannot be prevented that very warm water stagnates in the continuous flow heater. In the event of a high water temperature, limescale deposit often occurs in such stagnant water and reduces the performance and the service life of the continuous flow heater and is therefore undesirable.

Based on the above-described problem, it is an object of the present invention to provide a water system which is less susceptible to the problem of limescale deposit.

To solve the problem, the present invention proposes a water system according to claim 1. It is characterized in particular by a flushing station, which is provided connected to the warm water line, by way of which stagnant water in the warm water line can be drained in a chronological sequence, and which is configured such that the warm water line is flushed by the flushing station, which is instigated by the warm water being tapped from the water line via the consumer, until the water contained in the continuous flow heater is below a predetermined setpoint temperature.

The inventors of the present invention have found that, when a flushing station is coupled to the continuous flow heater, the latter can be flushed, which is instigated by the warm water being tapped, until the temperature of the water that is stagnant in the continuous flow heater drops below the predetermined setpoint temperature, so that the problem of limescale deposit is prevented. Such instigation for flushing can be given in that it is determined that warm water tapping at a consumer has been terminated or termination of warm water tapping at a consumer is imminent. It can at least be decided, instigated by the warm water being tapped, whether flushing is to be performed. It can be the case, for example, that flushing is performed in the context of the tapping, in particular, once it has been ascertained that warm water is no longer tapped from the consumer.

Such flushing stations in connection with water systems are generally known. For example, such a flushing station is described in European patent application EP 1 845 207 A1, the design of which and the design of the system described therein are incorporated by reference as disclosure content into the present invention. In prior art, however, such flushing stations are merely used to reduce the risk of germs forming due to the water being stagnant in the lines. Therefore, forced flushing is performed when the water in the respective line has stagnated for an extended period of time or only a small amount of water has been tapped over a long period of time. Flushing is controlled by a flushing schedule which is stored in a control device of the flushing station.

The inventors have found that cooling the water as quickly as possible in the heat exchanger is achieved where a control device, by way of which the continuous flow heater is controlled, is coupled to the flushing station, in particular to the control device thereof, so that the flushing station contains a further function and flushing always occurs when the tapping of warm water is terminated or it is determined that termination of the tapping is imminent in the near future and the risk of stagnation of the warm water in the continuous flow heater arises. When, namely, flushing occurs as soon as the consumption of warm water is terminated, cold water enters the continuous flow heater through a water supply line of the latter and displaces the warm water stagnating there, so that cooling takes place in the continuous flow heater. Limescale deposit in the continuous flow heater can thus be effectively prevented. It is not necessary that a flushing schedule be stored in the flushing station for flushing in the event of water stagnation in the line in order to prevent germs from forming. It is sufficient for the invention that the flushing station is controlled in such a way that the flushing is performed, as soon as warm water tapping from the warm water line via the consumer is terminated, until the water contained in the continuous flow heater is below the intended setpoint temperature.

According to a development of the invention, a control device can be provided for switching on or off a heating operation of the continuous flow heater, and the flushing station can be configured such that the warm water line is flushed until the continuous flow heater is below the predetermined setpoint temperature when the control device switches off the heating operation of the continuous flow heater. Flushing is performed by the flushing station, in particular, when the continuous flow heater has been switched off. Because the continuous flow heater is always switched off by the control device as soon as warm water is no longer needed, i.e. a user closes the consumer and no warm water is tapped from the warm water line.

In order for no additional evaluation routine needing to be stored in the control device that controls the flushing station, switching on or off the continuous flow heater can be used as an instigation for controlling the flushing station.

According to one preferred development of the invention, the flushing station can be configured such that the warm water line is flushed until the water contained in the continuous flow heater is below a temperature of 40° C. Limescale deposit occurs with stagnant water, in particular, at water temperatures above 40° C. Such limescale deposit takes place all the more, the higher the temperature of the stagnant water. Since the water system is a warm water line, the water is often heated to temperatures of up to 45° C. to 75° C. The actual conditions for limescale deposit also depend on the hardness of the water. The harder the water, the lower the temperature at which limescale deposit occurs. It has been found that flushing is preferably performed until the temperature is at least below 40° C. Further preferred ranges can have the following threshold temperatures: less than 60° C., less than 50° C., less than 35°, room temperature. Due to the above-described control for cooling the water in the continuous flow heater to the aforementioned temperature, limescale deposit is effectively prevented.

According to one advantageous development of the invention, a temperature sensor can be provided which is associated with the continuous flow heater and with which the control unit measures the temperature. On the basis of the values measured, the control unit decides whether the predetermined setpoint temperature has been reached. It is advantageous to provide a temperature sensor in order to measure the temperature of the water contained in the continuous flow heater. It can be provided, for example, on the output side at a warm water outlet of the continuous flow heater that is connected to the warm water line. Such a temperature sensor can be any temperature sensing element. This temperature sensor is in data communication with the control device and the data measured is evaluated in the control device in order to forward signals from there to the flushing station so that forced flushing is performed in dependency of the temperature: once the temperature measured drops below the predetermined temperature, the control device again shuts off the flushing station.

According to one advantageous development of the invention, the control device can control the continuous flow heater and the flushing station. The control device can be formed from a combination of a first microcomputer or a first control device, respectively, which is provided in the continuous flow heater, and a second microcomputer or a second control device, respectively, which is provided in the flushing station. Both control devices communicate with one another, where the relevant control routines, with which the continuous flow heater is controlled, are advantageously stored in the control device of the continuous flow heater. The control routines controlling the flushing station are advantageously stored in the control device of the flushing station.

In this case, the control device of the continuous flow heater is coupled to the control unit of the flushing station and instructs the latter to control (open or close) the flushing station according to the operation of the continuous flow heater. The communication can take place using a wired system or also a wireless network (WLAN). Alternatively, a common control module can also be provided and control the continuous flow heater and the flushing station as a module. The method according to the invention is further improved by the communication between the continuous flow heater and the flushing station.

According to one development of the invention, the flushing station can be configured such that the warm water line is always flushed when no or only a small amount of water has been tapped from the warm water line after a predetermined period of time. In addition to the flushing according to the invention, the flushing station can contain the functionalities of a forced flushing system for hygiene considerations already known in prior art as soon as tapping of warm water from the water line via the consumer has been terminated. A program for forced flushing can then be stored in the flushing station or in one or both of the control units so that forced flushing takes place when little or no water has been tapped for a certain time, so that water exchange can occur to prevent germs from developing. Corresponding flushing is described, for example, in EP 1 845 207, the disclosure content of which is incorporated by reference in the present application. Due to the combination of forced flushing for reasons of hygiene and forced flushing for reasons of limescale deposit described, a simple system is provided which utilizes the elements that are already present in prior art, such as a flushing station and a continuous flow heater, and provides them with a functionality which ensures that operation of the system over a longer period of time is possible.

According to one development of the invention, a flow meter can be provided by way of which the control unit decides whether the warm water line is being flushed. The flow meter is preferably to be provided in the warm water line in order to better determine the extent to which water is consumed by a consumer or not. This flow meter can be coupled to the control device. Conclusions can be drawn therefrom about whether or not water is consumed and whether water in the continuous flow heater stagnates. The functionality of the system can be further improved by providing the flow meter.

According to one advantageous development of the invention, a cold water line for supplying cold water to at least one second consumer connected thereto can be provided in the water system, and the flushing station can be connected to the cold water line. In addition to the warm water line, a cold water line is often provided in such water systems in buildings, since mixing taps are often connected to this line and mix the water from the warm water line and the cold water line in order to make water available at a pleasant temperature.

The problem of lacking hygiene with prolonged stagnation of water also arises in such a cold water line. It is advantageous to have the cold water line also be connected to the flushing station. In this case, such a flushing station is to comprise, for example, a common housing in which two valves are provided via which the water can be drained from the respective cold water or warm water line into the waste water system. In the simplest case, an actuatable valve, in particular a motor-actuatable one, can be seen as a flushing station. When combining cold and warm water lines, two such valves are then provided. The combination of a valve for the cold water line and a valve for the warm water line in a common flushing station further reduces the components required for configuring a water system.

According to an advantageous development of the invention, the continuous flow heater can be formed by a plate heat exchanger with a primary circuit and a secondary circuit and a heat exchanger plate provided between the circuits, where the fluid flowing in the primary circuit heats the water flowing through the secondary circuit before it is supplied to the warm water line. Such a heat exchanger is described, for example, in the European patent application with the application number 16 170 441.6 and the German utility model with the registration reference number 20 2015 003 756, the disclosure of which is incorporated by reference into the present application. In a heat exchanger, a secondary fluid, presently the water to be heated, which is delivered into the warm water line and consumed by the consumer, is heated via a primary fluid, for example, warm water from a heating device. The heat is transferred between the two fluids via the heat plate. Such a heat exchanger plate can have corrugated or otherwise deformed portions so that such a plate does not need to have a completely planar surface. The plane, in which the plate is located, is therefore in particular to be understood to be that plane in space which includes the main surface portions of the plate that have not been deformed in the provision process of the plate.

According to one development of the invention, the primary circuit can be connected to a heating unit for heating a building, and the secondary circuit can be part of a potable or tap water line of a building. If the fluid circuit of a heating unit of a heating for a building is used as the primary circuit, it is in a simple way possible to use the systems already existing in the building also for heating the water.

According to one development of the invention, the plate heat exchanger can be arranged such that the heat exchanger plate is disposed inclined relative to the direction of gravity. When the plate heat exchanger is placed in an inclined manner, stagnant water in the secondary circuit can be better mixed and limescale deposit be prevented. In particular, a micro-circulation is formed between the cold and the warm water in the respective compartment due to the inclined position of the heat exchanger plate, which leads to faster cooling and therefore to reduced limescale deposit. These plate heat exchangers placed in an inclined manner and advantages thereof are described in the European patent application with the application number 16 170 441.6 and the German utility model with the registration reference number 20 2015 003 756, the disclosure content of which is incorporated by reference into the present application.

An angle of such an inclined plane can be between more than 0° and less than 90°. Preferred values are 9° to 50°, 10° to 30°, and in particular 15° to 35°.

According to a further development of the invention, a water supply line for supplying cold water can be provided on the continuous flow heater at the inlet side, and the cold water line can branch off from the water supply line. A particularly compact configuration of the system can be provided where the cold water line is connected directly to the water supply line of the continuous flow heater.

According to one development of the invention, the plate heat exchanger can be provided in a housing module, with ports provided thereon for a heating feed line and a heating return line, for connecting the primary circuit of the plate heat exchanger to the heating unit, a port for the water supply line, a port for the warm water line, and a port for the cold water line. When such a housing module is provided, it can be integrally formed with the respective ports provided thereon and installed at a transfer location, e.g. at the entrance of the apartment or the building, for example, as an in-wall component. Such a housing module can be, for example, a sheet metal or plastic box in which the respective ports, the control device, and the continuous flow heat exchanger are provided.

The flushing station can also be formed by such a module, which is then provided separately from the module of the plate heat exchanger. Alternatively, however, everything can also be integrated into one module and be designed in the manner of an in-wall installation box.

Further details and advantages of the present invention shall become apparent from the following description of embodiments in combination with the drawing, in which.

Figure 1:
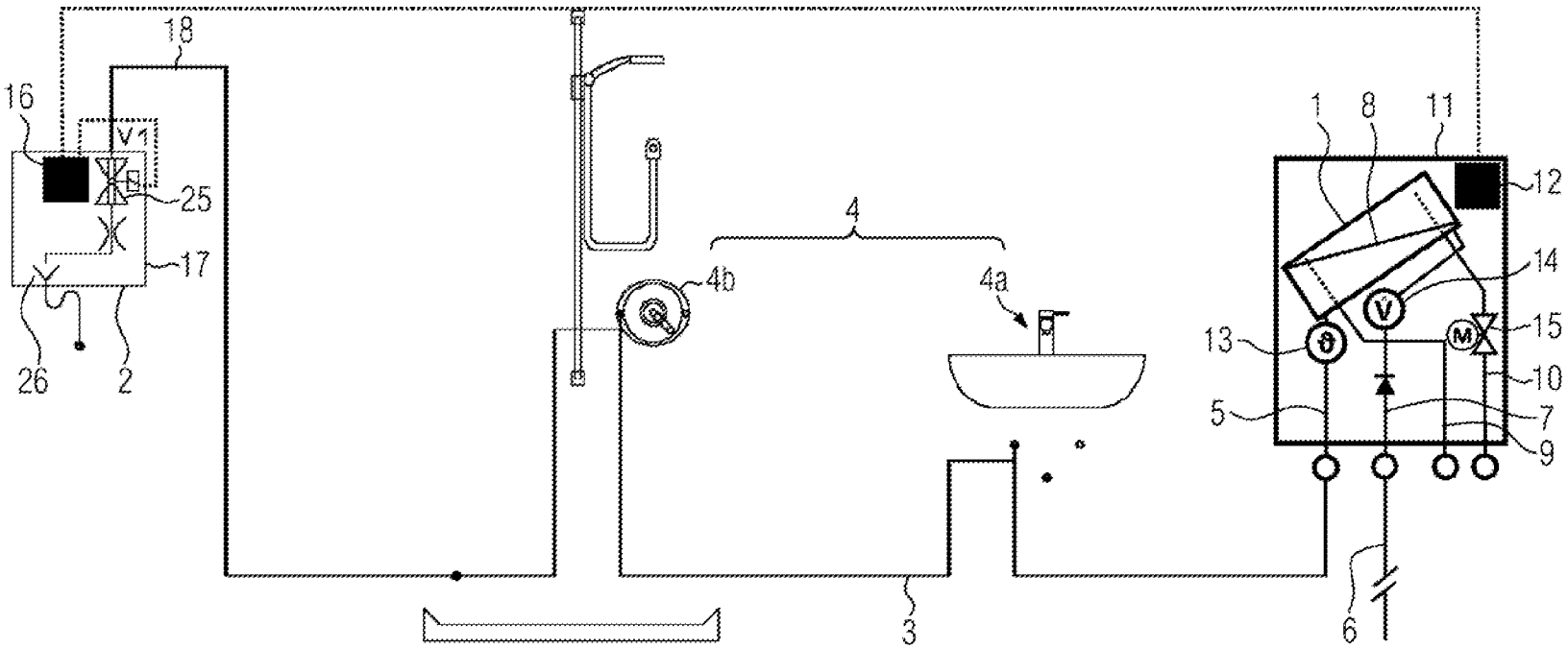
FIG. 1 shows a first embodiment of a water system according to the invention.

FIG. 1 shows an example of a water system according to the invention. It comprises a continuous flow heater 1, a flushing station 2 and a warm water line 3, which connects the continuous flow heater 1 to the flushing station 2. Connected as a consumer 4 to the warm water line 3 are a wash basin tap 4*a* and a shower tap 4*b*.

Any number of consumers 4, or even just one consumer 4, can be connected to the warm water line 3 between the continuous flow heater 1 and the flushing station 2. In the present case, the warm water line 3 is a floor line of an apartment. The warm water line 3 can be any warm water line, for example, a line or a line section in a water system of single-family houses or large buildings such as, for example, hospitals. The warm water line 3 can be a floor line and/or a riser line.

The warm water line 3 is connected to a warm water outlet 5 of the continuous flow heater 1. Cooling water flows through a water supply line 6, which is connected to a water supply inlet 7 of the continuous flow heater 1, into the continuous flow heater 1, is heated in the latter and flows as warm water through the warm water outlet 5 into the warm water line 3. The warm water outlet 5 as well as the water supply inlet 7 can be provided as a pipe section or connection port.

In the embodiment according to FIG. 1, the respective connection ports for the warm water outlet 5 and the water supply inlet 7 are arranged in parallel next to one another in order to establish a simple connection to the pipes.

In this case, the continuous flow heater is a so-called plate heat exchanger 1. In a plate heat exchanger 1, heat is transferred via a heat exchanger plate 8, which is shown as a line in the figures, from a fluid flowing in a primary circuit to a fluid flowing in a secondary circuit. In the present case, the fluid flowing in the so-called secondary circuit is the water to be heated by the plate heat exchanger. In the present example, the fluid flowing in the primary circuit is warm water flowing through a heating circuit of a heating system. This heating water flowing in the primary circuit is therefore not consumed and is constantly re-circulated and heated by a heating system (not shown). The water flowing in the secondary circuit is consumed. The term circuit is therefore chosen for purely formal reasons in this respect, because it is not a circuit in the narrow sense, since the water is consumed.

Such a plate heat exchanger is known, for example, from DE 20 2008 003 349 U1, DE 10 2010 018 086 A1 as well as the European patent application with the registration number 16 170 441.6 and the German utility model with the registration reference number 20 2015 003 756. The plate heat exchangers described in these documents are incorporated by this reference into the present disclosure.

The plate heat exchanger is operated following the countercurrent principle, meaning, the cold water to be heated flows via the water supply line 6 into the right upper side of the plate heat exchanger shown in FIG. 1, and is heated therein as it again exits substantially in an inclined manner, flowing downwardly to the left and out from warm water outlet 5.

The heated water arriving from the heating device (not shown in FIG. 1) flows via a heating feed line inlet 9 described in FIG. 1 into the continuous flow heater 1 (see lower left side of the continuous flow heater 1 in FIG. 1), flows along the heat exchanger plate 8 in countercurrent through the continuous flow heater 1, and is returned to the heating in the upper right region of the continuous flow heater 1 through the heating return line outlet 10 of the heat exchanger 1.

The heating feed line inlet 9 and the heating return line outlet 10, as well as the warm water outlet 5 or the water supply inlet 7, respectively, can be provided as pipe segments or connection ports, all of which are arranged in parallel alignment to each another, at least next to each other in the heat exchanger housing module 11 shown schematically in FIG. 1. It is not necessary that the primary circuit actually be connected to a heating unit in a building, it can also be connected to a district heating system or any other possible source of warm fluid.

Figure 3:
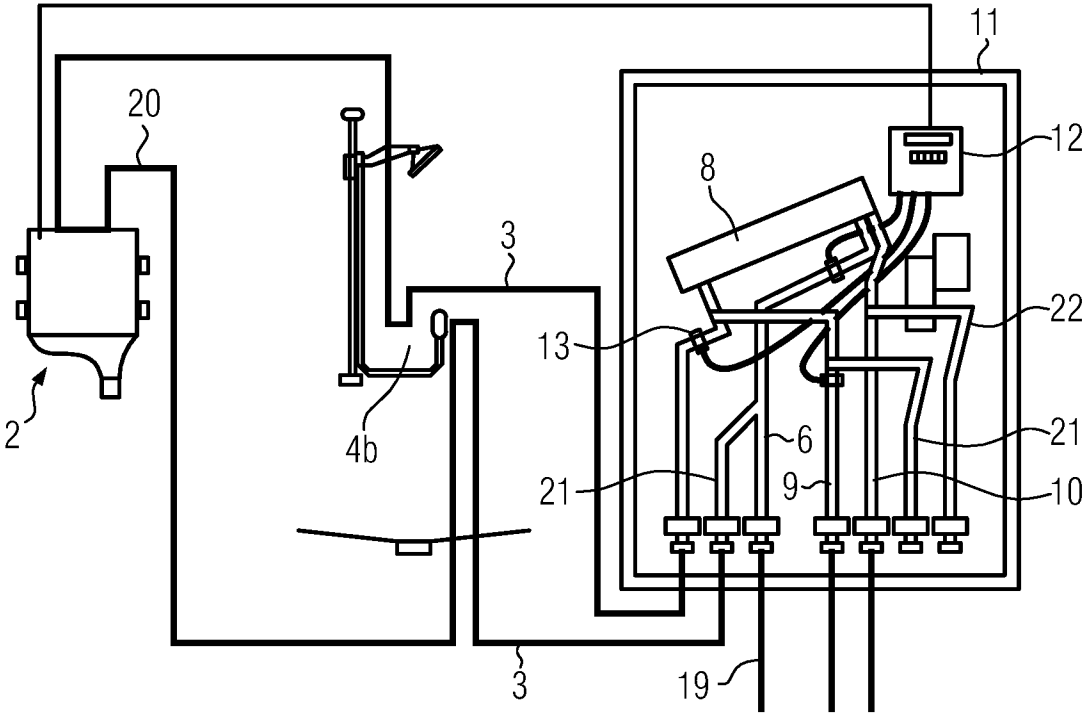
FIG. 3 shows a second embodiment of a water system of the present invention.

The heat exchanger housing module 11, like in a second exemplary embodiment illustrated in FIG. 3 and described later, can be designed as a type of in-wall installation box which is installed, for example, at a (water) supply inlet of an apartment and/or a building This embodiment provides a simple connection option. As can be seen in FIG. 3, the heat exchanger housing module 11 can be configured as a kind of sheet-metal box in which also a control device 12 for controlling the continuous flow heater 1 is provided in addition to the continuous flow heater and the individual connection ports.

In addition to the control device 12, a temperature sensor 13 is provided in the embodiment according to FIG. 1 in the heat exchanger housing module 11 on the outlet side at the continuous flow heater 1, specifically at the warm water outlet 5. In addition, a continuous flow sensor 14 is provided on the inlet side at the water supply inlet 7. Both sensors 13, 14 are connected to the control device 12. It is determined in the control device 12 by way of the continuous flow sensor 14 whether the continuous flow heater 1 is in operation, i.e. whether water flows through it and is heated, or whether the water stagnates therein because no warm water is tapped via the consumer 4.

Such a continuous flow sensor 14 can also be used in the primary circuit, e.g. can be provided at the heating feed line inlet 9. The heat transfer is controlled, in particular, by the flow rate in the primary circuit, as is described, in particular, in German utility model application DE 20 2015 103 940.9, the disclosure content of which is incorporated by reference into the present application. The flow rate through the primary circuit is controlled by way of the control unit 12 via the valve 15, which in the present case is provided at the heating return line outlet 10. When it is completely closed, no water flows through the primary circuit and further heating of water in the secondary circuit also does not occur. Such a control of the heat exchanger is also described in German utility model application DE 20 2015 103 940.9, the disclosure content of which is incorporated by reference into the present application.

In the present embodiment, the control device 12 of the continuous flow heater is connected to a further control device 16 in the flushing station 2 by way of a line indicated as a dotted line. The control device 12 of the continuous flow heater 1 provided in the heat exchanger housing module 11, together with the further control device 16 provided in the flushing housing module 17 of the flushing station 2, forms the control device of the combined system shown in FIG. 1.

The essential functions of the inventive controlling of the flushing station 2 described below in dependence of a state of the continuous flow heater 1 are stored, for example, in the control device 12 of the continuous flow heater 1, and the control device 16 of the flushing station 2 is controlled by it in a slave mode.

An example of a flushing station 2 is described, for example, in European patent application EP 1 845 207 A1, the disclosure content of which regarding the flushing station is incorporated by this reference into the present application. The flushing station 2 comprises a flushing valve 25 and, in the simplest case, can be formed by a controlled flushing valve. The flushing valve 25 is controlled by the control device 16 of the flushing station 2 via the line indicated as a dotted line in FIG. 1. In the open state, the flushing valve 25 is closed between the warm water line 3 and a waste water port 17, so that no water can be discharged therethrough. When the control device 16 of the flushing station 2 opens the flushing valve 25, a flow causing a so-called flush flow is created in the warm water line 3 and the water of the warm water line 3 is introduced e.g. via a waste water port 26 into the public sewage supply network. The waste water port 26 can have any configuration.

Flushing via the flushing station is performed, for example, in the system known from European patent application EP 1 845 207 A1 in order to reduce the risk of germs forming, since the water in the line stagnates when water is not tapped by the consumer. By flushing, i.e. actuating the flushing valve 25 in dependence of the use by the consumers, the risk of such germs forming is reduced. For this purpose, a predefined flushing plan can be stored in the control device 16 of the flushing station 2. The functions stored in the control device of the flushing station 2 can in the present example alternatively also be stored in the control device 12 of the continuous flow heater 1 because these two elements communicate with one another and together form a control device.

Advantageously, the new functions of the continuous flow heater 1 provided by the present invention as well as other functions of the continuous flow heater 1 are stored as program codes in the control device 12 of the continuous flow heater 1. The control parameters of the flushing station 2 are advantageously stored, e.g. in the control device 16 of the flushing station 2

The control device 12 of the continuous flow heater 1 can instruct the control device 16 of the flushing station 2 to open the flushing valve 25 once a condition is fulfilled or it is detected in the continuous flow heater that flushing is required to reduce the risk of calcification.

Similarly to the continuous flow heater 1 which can be provided in a heat exchanger housing module 11, the flushing station 2 is provided in a flushing station housing module 17 which can be configured as an in-wall installation box, as described above for the heat exchanger housing module 11. This flushing station housing module 17 can be provided as a separate element in the building. However, it is also possible to combine the heat exchanger and the flushing station in a common housing and to mount the latter at the transfer point or the discharge point to the public water supply network, e.g. in the apartment entrance/exit area.

In the present case, the flushing station is connected at an end section 18 of the warm water line 3 and downstream of the consumers 4*a*, 4*b*. The flushing station 2 can also be connected at any other desired location or between the consumers 4*a*, 4*b*.

The present invention proposes, in particular, a combination of the flushing station 2 and the continuous flow heater 1, and controlling the flushing station 2 with the control device 12 of the continuous flow heater 1 in order to prevent, for example, limescale deposit from forming in the secondary circuit.

In the present case, the continuous flow heater 1, configured as a plate heat exchanger, is installed in the heat exchanger housing module 11 such that a plane, in which the heat exchanger plate 8 is located, is disposed inclined relative to the direction of gravity. This inclined position of the continuous flow heater 1 makes it possible to reduce the risk of limescale formation. The advantages of the inclined position are described in the European patent application with the application number 16 170 441.6 and the German utility model with the registration reference number 20 2015 003 756, the disclosure content of which is incorporated with this reference into the present application.

At high water temperatures, CO2 is emitted, causing the pH value of the water to rise and limescale to deposit. Undesirable limescale deposit can occur when the water is stagnant, in particular, at water temperatures above 40° C.

Due to the inclined position of the continuous flow heater 1 shown in FIG. 1, faster intermixing takes place with the cold water supplied, which passes through the water supply line 6 into the continuous flow heater 1.

Because the cold water flows into the continuous flow heater 1 on the upper right side shown in FIG. 1 and drops downwardly to the left along the inclined heat exchanger plate 8, whereby intermixing with the warm water on the outlet side occurs. This intermixing leads to the water in the continuous flow heater 1 cooling down, which reduces the limescale deposit.

However, it has now been found that this limescale deposit cannot always be prevented with the intermixing instigated by gravity. For this reason, the present invention proposes that the warm water line 3 be flushed until the water contained in the continuous flow heater 1 is below a predetermined setpoint temperature once tapping warm water from the water line via the consumer is terminated.

When e.g. the continuous flow heater 1 is switched off via the control device 12, for example, by closing the valve 15, since no warm water is tapped and no warm water is required, forced flushing can be carried out via the flushing station 2. The warm water is then withdrawn from the primary circuit of the continuous flow heater 1 via the flushing station 2, and cooling down takes place.

The flushing station 2 can be instructed by the control device 12 of the continuous flow heater 1 to preferably remain in the open state until the temperature is below the critical temperature for limescale deposit. This is preferably a temperature of below 40° C. However, it is not necessary to specifically select the temperature of below 40° C. It is sufficient for the present invention that the control device controls the flushing station 2 in such a way that the warm water line 3 is flushed until the water contained in the continuous flow heater 1 is below a predetermined setpoint temperature.

The present invention thereby prevents or reduces calcification in the continuous flow heater 1.

It is also not necessarily the case that the flushing station 2 is set such that forced flushing is performed during stagnation for the risk of germs forming. For the invention, it is sufficient that at least one flushing is performed to prevent or reduce calcification.

No cold water line is shown in the embodiment of FIG. 1, but the consumers 4 are typically also connected to the cold water line. This is the case, for example, schematically in the second embodiment according to FIG. 3. In the second embodiment, identical elements are designated with the same reference numerals as in the embodiment of FIG. 1. Only the differences to the embodiment according to FIG. 1 shall be explained below.

Instead of the consumers provided in the warm water line 3, (wash basin tap 4*a* as well as the shower tap 4*b*), only one shower tap 4*b* is provided as a consumer in the second embodiment.

In the embodiment according to FIG. 3, a cold water line 19 branching off from the water supply line 6 is additionally illustrated, to which the same shower fitting 4*b* is connected that is also connected to the warm water line 3.

The flushing station 2 is connected to one end section 20 of the cold water line 19. The flushing station 2 contains two flushing valves 16, which can not be seen in FIG. 3, and which can be actuated separately and independently of the control device 16 of the flushing station 2 in order to force-flush the cold water line 19 or the warm water line 20, respectively.

The cold water line 19 is connected to the water supply inlet 7 such that a cold water line outlet port 21, just like the further connection ports, are arranged to each other in the heat exchanger housing module 11, which leads to easier connectability to pipe segments.

A further pipe section 20, 22, which ensures circulation in the circuit of the heating when the valve 15 is closed or only partially open, is connected to both the heating feed line inlet 9 as well as to the heating return line outlet 10.

The pipe segment 21, which is connected to the heating feed line inlet 9, therefore leads, for example, to heating ribs or heat-consuming elements, and the return from these heating ribs or heat-consuming elements flows through the pipe section 22.

The temperature sensor provided with reference numeral 13 in FIG. 3 is coupled to the control device 12 of the continuous flow heater 1 and measures the temperature at the outlet of the continuous flow heater in the primary circuit. This makes it easier to determine whether a predetermined temperature has been reached after forced flushing.

Figure 2:
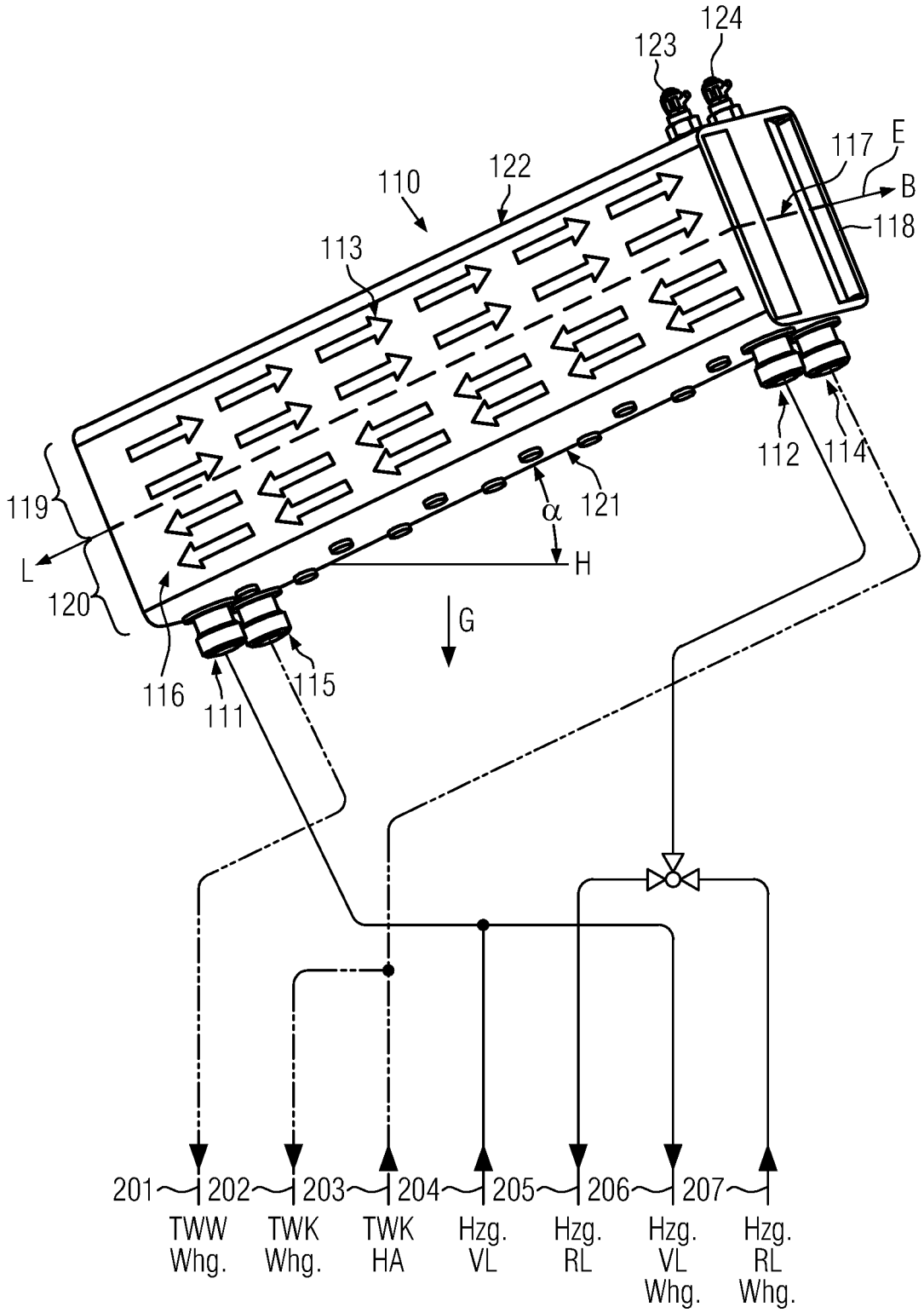
FIG. 2 shows an example of a continuous flow heater designed as a plate heat exchanger which is useful for understanding the present invention.

FIG. 2 illustrates a perspective side view of an exemplary plate heat exchanger 110 with an inlet 111 and an outlet 112 of a primary circuit 113, an inlet 114 and an outlet 115 of a secondary circuit 116, and a plate 117 indicated as a dot-dashed line which separates the two circuits 113, 116 from each other.

The plate 117 separates the interior of a housing—marked with reference numeral 118—of the plate heat exchanger 110 into two compartments 119, 120. The compartment 119 is the flow region for the fluid flowing in the primary circuit. In the compartment 120, the fluid of the secondary circuit 116 flows through the housing 118. As is evident, the inlet 111 of the primary circuit and the outlet 115 of the secondary circuit are located at the bottom edge of the housing 118 near an edge which is defined by a front end of the housing 118. The outlet 112 of the primary circuit and the inlet 114 of the secondary circuit are located at the opposite end of an underside of the housing 118. This underside is defined by a side wall 121 of the housing 118. The compartment 119 for the primary circuit 113 is at the upper side defined by an upper side wall 122 of the housing. This upper side wall 122 of the housing is at its upper end near the front side provided with two vent valves 123, 124. It is understood that a plurality of compartments of the kind described above can be arranged in the plate heat exchanger above each other and alternatingly. Only one compartment was illustrated, namely enlarged, to express more clearly the nature of the invention. The respective compartments are at the end side in communication with the inlets 111, 114 and outlets 112, 115, respectively.

The horizontal is in FIG. 2 indicated by line H. The inclination of the housing, i.e. the walls 121, 122 provided in parallel relative to this horizontal H, is marked by angle $\alpha$. Presently, $\alpha=35°$. Also the plate 117 is inclined relative to the horizontal H at a respective angle. Perpendicular thereto, G indicates the gravitational field of the earth. The plate 117 separating the compartments has a surface normal N which runs at the same angle $\alpha$ relative to vector G of the gravitational field of the earth.

FIG. 2 shows the installation situation with the connection lines which are connected to respective lines for warm potable water (TVWV), for cold potable water which is provided by the domestic connection (TWK HA), for heating water (Hzg.), where VL depicts the feed and RL the return. The heating pipes with the further index Whg. are connected to the apartment and are the feed and return lines for the house unit. The corresponding lines are numbered with reference numerals 201 through 207. A line 208 connects the inlet 114 of the secondary circuit for potable water of the plate heat exchanger 110 to a branch-off, to which also the lines 202 and 203 are connected. The outlet of the secondary circuit 115 is connected to the line 201. The inlet of the primary circuit 111 is connected via a T-piece to the line 204 for the heating feed. The outlet 112 of the primary circuit is in communication via the line 209 and a three-way valve with the line 205 for the heating return, which can also be connected via the three-way valve to the heating return line 207 coming from the apartment. The lines 205 and 204 carry the heating water via a heating boiler, not shown, in which the heating water is heated.

The conceivable installation situation of the plate heat exchanger in the plate heat exchanger system shown in FIG. 2 is thereby exemplified. This installation situation corresponds to the situation of the second exemplary embodiment shown in FIG. 3.

The flow arrows drawn in in FIG. 2 indicate the circulation caused by free convection after switching off any flow caused by forced convection, which results in rapid temperature equalization within the heat exchanger, namely, due to the inclined orientation of the walls defining the individual compartments 119, 120. The quite cold fluid of the primary circuit 113 located relatively far at the top has a higher density than the slightly warmer fluid of the same circuit 113 located therebeneath. The same applies for the relatively cold fluid of the secondary circuit 116 disposed in the region of the inlet 114 in relation to the fluid of the same circuit located close to the outlet 115. The colder fluid has a stronger tendency to descend due to the higher density. When descending, it presses the relatively warm fluid of the same compartment 119 or 120 upwardly. This results in a micro-circulation due to the different densities which only reaches a standstill when the temperature within the compartments is substantially equalized. Faster temperature equalization and thereby less calcification therefore arise with the solution according to the invention.

In FIG. 2 at the height of the plate 117, the latter's length L and its width B are marked in the form of direction vectors. Direction vector L there denotes the direction of the greatest extension, i.e. the extension in length of the plate 117, and vector B denotes the direction of the extension of the plate in the second greatest direction, i.e. the width direction. Vectors L and B presently span a plane E to which the surface normal N is oriented orthogonally. The presently flat plate 117 is there located entirely within this plane E and itself defines this plane E.

Figure 4:
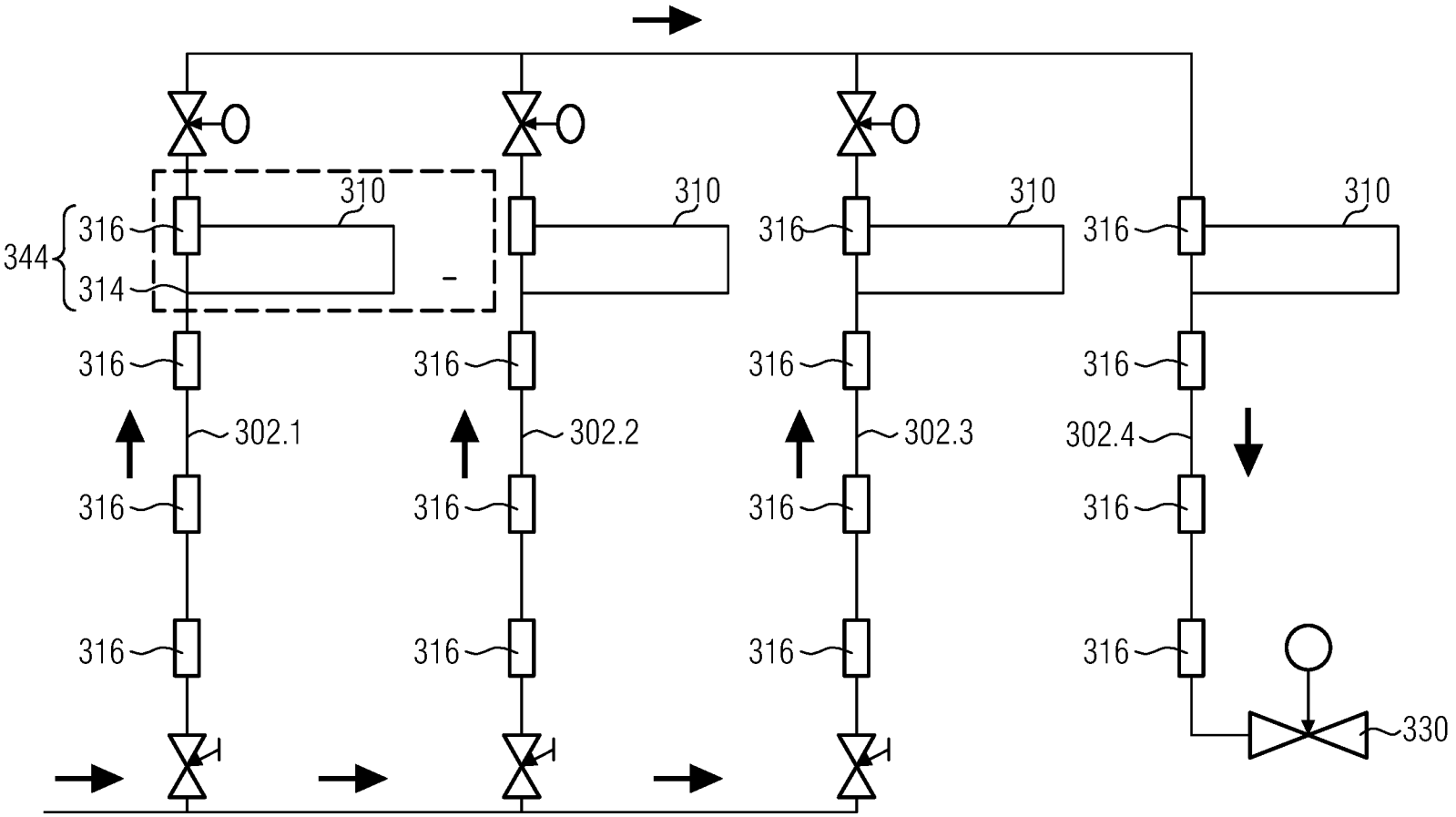
FIG. 4 shows an example of a flushing valve, which is contained in a flushing station, by way of which a plurality of floor lines and riser lines are flushed.

FIG. 4 shows an example of a system of floor lines and riser lines, to the ends of which a flushing valve 330 is connected The flushing valve 330 from the example of FIG. 4 can be integrated into or form the flushing station 2 (not shown in this figure). The example illustrated in FIG. 4 illustrates a potable or tap water installation by way of the example of a hotel or hospital. Several vertical riser lines 302.1, 302.2, 302.3 are there provided, from which ring lines 310 branch of to the individual floors.

The branch-off 314 and the return 316 of the respective ring line 310 are provided on a common ring line flushing fitting 344, which is designed as a branch-off and connection fitting. The ring line can be flushed with the ring line flushing fitting 344 due to a pressure difference prevailing in the riser lines. Further details of the system shown in FIG. 4 are described in the European patent application EP 1 845 207 A1, the disclosure content of which is incorporated by reference into the present application.

For example, instigated by the tapping of warm water, the flushing station 2 in the system shown in FIG. 4 can be controlled by way of the control device 12 of the continuous flow heater 1 (not shown in this example).

continuous flow heater 1
flushing station 2
warm water line 3
consumer 4
wash basin tap 4*a*
shower tap 4*b*
warm water outlet 5
water supply line 6
water supply inlet 7
heat exchanger plate 8
heating feed line inlet 9
heating return line outlet 10
heat exchanger housing module 11
control device for the heat exchanger 12
temperature sensor 13
continuous flow sensor 14
valve 15
control device for the flushing station 16
flushing station housing module 17
end section 18
cold water branch-off 19
end section 20
pipe section 21, 22
flushing valve 25, 330
waste water port 26
plate heat exchanger 110
inlet of the primary circuit 111
outlet of the primary circuit 112
primary circuit 113
inlet of the secondary circuit 114
outlet of the secondary circuit 115
secondary circuit 116
plate 117
housing 118
compartment 119, 120
lower side wall of the housing 121
upper side wall of the housing 122
vent valves 123, 124
ring line 310
branch-off 314
return 316
ring line flushing fitting 344
riser lines 302.1, 302.2, 302.3

The invention claimed is:

1. A water system with:

a warm water line supplying at least one first consumer connected thereto with warm water;

a continuous flow heater connected to the warm water line, wherein cold water introduced into the continuous flow heater is heated;

a flushing station connected to the warm water line for flushing the warm water line;

wherein the flushing station comprises a waste port and a flushing valve for discharging water in the warm water line (3) into the waste port (26);

a control device for opening or closing the flushing valve of the flushing station; and a temperature sensor associated with the continuous flow heater for measuring the temperature of water contained in the continuous flow heater;

wherein the control device is configured to open the flushing valve of the flushing station as soon as a heating operation of the continuous flow heater has been switched off; and wherein the control device is configured to close the flushing valve of the flushing station once the temperature measured by the temperature sensor drops below a predetermined setpoint temperature.

2. The water system according to claim 1, wherein the control device also switches on or off the heating operation of the continuous flow heater.

3. The water system according to claim 1, wherein the flushing station is configured such that water in the warm water line is drained until the water contained in the continuous flow heater is below a temperature of 40° C.

4. The water system according to claim 1, wherein the flushing station is configured such that water of the warm water line is always drained when the at least one first consumer has not tapped water from the warm water line over a predetermined period of time.

5. The water system according to claim 2, wherein a flow meter is further provided, by way of which the control device decides whether the warm water line is being flushed.

6. The water system according to claim 1, wherein a cold water line is provided in the water system for supplying at least one second consumer connected thereto with cold water, and in that the flushing station is connected to the cold water line.

7. The water system according to claim 1, wherein the continuous flow heater is formed by a plate heat exchanger with a primary circuit and a secondary circuit and a heat exchanger plate provided between the primary circuit and the secondary circuit, where the fluid flowing through the primary circuit heats the water flowing though the secondary circuit before the water is supplied to the warm water line.

8. The water system according to claim 7, wherein the primary circuit is connected to a heating unit for heating a building, and the secondary circuit is part of a potable or tap water line of a building.

9. The water system according to claim 7, wherein the plate heat exchanger is arranged such that the heat exchanger plate is disposed inclined relative to the direction of gravity.

10. The water system according to claim 6, wherein a water supply line for supplying cold water to the continuous flow heater is provided at the inlet side of the latter, and the cold water line branches off from the water supply line.

11. The water system according to claim 7, wherein the plate heat exchanger is provided in a housing module, with ports provided thereon for a heating feed line and a heating return line, for connecting the primary circuit of the plate heat exchanger to the heating unit, a port for the water supply line, a port for the warm water line, and a port for the cold water line.

12. A water system with:

a warm water line supplying at least one first consumer connected thereto with warm water a continuous flow heater connected to the warm water line, wherein water introduced into the continuous flow heater is heated;

a water supply line for supplying cold water to the continuous flow heater;

a flushing station connected to the warm water line, the flushing station comprising a waste water port and a flushing valve for discharging water in the warm water line into the waste water port; and a control device for switching on or off a heating operation of the continuous flow heater and for opening or closing the flushing valve of the flushing station;

wherein the control device is configured to open the flushing valve of the flushing station as soon as the heating operation of the continuous flow heater has been switched off;

wherein a temperature sensor associated with the continuous flow heater is provided for measuring the temperature of water contained in the continuous flow heater; and wherein the control device is configured to close the flushing valve of the flushing station once the temperature measured by the temperature sensor drops below a predetermined setpoint temperature.

13. The water system according to claim 12, wherein the flushing station is configured such that the warm water line is always drained when the at least one first consumer has not tapped water from the warm water line over a predetermined period of time.

14. The water system according to claim 12, wherein a cold water line is provided in the water system for supplying at least one second consumer connected thereto with cold water, and wherein the flushing station is connected to the cold water line.

15. The water system according to claim 14, wherein the water supply line is provided at the inlet side of the continuous flow heater, and that the cold water line branches off from the water supply line.

16. A water system with:

a warm water line supplying at least one consumer connected thereto with warm water;

a continuous flow heater connected to the warm water line, wherein cold water introduced into the continuous flow heater is heated;

a water supply line connected to the continuous flow heater for supplying the cold water to the continuous flow heater;

a flushing station connected to the warm water line for flushing the warm water line, the flushing station comprising a waste water port and a flushing valve for discharging water in the warm water line into the waste water port; and a control device for opening or closing the flushing valve of the flushing station;

wherein a temperature sensor is provided at an outlet of the continuous flow heater for measuring the temperature of water contained in the continuous flow heater;

wherein a flow sensor is provided at an inlet of the continuous flow heater for determining whether tapping of warm water from the warm water line via the consumer has terminated; and wherein the flushing station is provided downstream of the at least one consumer;

wherein the control device is configured to open the flushing valve of the flushing station as soon as a heating operation of the continuous flow heater has been switched off; and wherein the control device is configured to close the flushing valve of the flushing station once the temperature measured by the temperature sensor drops below a predetermined setpoint temperature.

17. The water system according to claim 16, wherein the continuous flow heater is a plate heat exchanger arranged in a heat exchanger housing module, the heat exchanger housing module having a connection port for each of a heating feed line, a heating return line, the warm water line and the water supply line, wherein the heating feed line and the heating return line are connected to a 5 primary circuit of the plate heat exchanger and the warm water line and the water supply line are connected to a secondary circuit of the plate heat exchanger, the primary circuit and the secondary circuit being separated by at least one heat exchanger plate.

* * * * *